US006237775B1

(12) United States Patent
Hatch et al.

(10) Patent No.: US 6,237,775 B1
(45) Date of Patent: May 29, 2001

(54) STACKING FOOD PAN WITH LOUVERED VENTILATION MEANS

(76) Inventors: Brett Hatch; Burton Hatch; True Hatch; Barlow Hatch, all of 555 Reed St., Santa Clara, CA (US) 95050

( * ) Notice: Subject to any disclaimer, the term of this patent is extended or adjusted under 35 U.S.C. 154(b) by 0 days.

(21) Appl. No.: 09/563,375

(22) Filed: May 3, 2000

(51) Int. Cl.[7] ..... B65D 6/40
(52) U.S. Cl. ..... 206/519; 220/676; 220/661
(58) Field of Search ..... 220/676, 913, 220/661, DIG. 27, 573.1; 206/519, 518

(56) References Cited

U.S. PATENT DOCUMENTS 1,509,549 * 9/1924 Freeland .
2,227,990 * 1/1941 Zelt .
2,513,693 * 4/1950 Turbyfill .
5,700,689 * 12/1997 Wuster ..... 435/290.1
5,866,184 * 2/1999 Gorlich et al. ..... 426/396

* cited by examiner

*Primary Examiner*—Stephen Castellano
(74) *Attorney, Agent, or Firm*—The Kline Law Firm

(57) ABSTRACT

A food pan with at least one louvered vent in an upper area of a wall of the pan. The louvered vents allow air flow across the top of a serving table to be directed more efficiently toward the surface of the contents of the pan. The vents enable tempered air to flow easily across the surface of the contents of the pan so that the contents are maintained at the desired temperature. The louvers extend outward from the body of the pan so that an anti-jamming mechanism is formed when the pans are stacked together. This construction addresses the two chief problems connected to food pans.

5 Claims, 3 Drawing Sheets

STACKING FOOD PAN WITH LOUVERED VENTILATION MEANS

FIELD OF THE INVENTION

The present invention relates generally to food service equipment, and more particularly is a stacking food pan with louvered ventilation means.

BACKGROUND OF THE INVENTION

In the food service industry, it is often necessary to leave cold food on display or in refrigerated preparation tables for an extended period of time. Current regulations require that these devices be able to hold the entire food product at a temperature of 41° F. or less. However, the pans that hold the food themselves block air flow to the product, therefore making it difficult to maintain the temperature of the product in the pan at the required 41° F. or less.

The food service industry has addressed this problem in three ways: (1) blowing cooled air across the top of the pan; (2) providing freon lines in the pan receptacel walls; and (3) using divider bars wrapped with freon lines betwen pans. It is difficult to maintain the requireed temperatures by blowing air across the pans, and using freon lines requires periodic defrosting of the serving/preparation tabels.

Historically, the tops of the pans were flush to the surface of the display or preparation tables. To meet the newly instituted requirements, users had to either significantly lower the pans, which is extremely inefficient in ergonomic terms, or they had to lower the temperature of the walls of the preparation/serving tables. Lowering the temperature of the walls led, in many cases, to the freezing of the contents of the pans. Moreover, the reduced wall temperatures caused the tables to require periodic defrosting.

Another problem that plagues users of food pans is the pans' jamming together when stacked. When the pans are stored, they are typically nested one inside another to conserve space. It is not uncommon for the pans to become so tightly wedged together that they are very difficult to separate. This problem has been recognized in the industry for some time, and has led to assorted methods of preventing pans from jamming together when stacked.

Accordingly, it is an object of the present invention to provide a food pan that allows better temperature regulation by improving air flow across the contents of the pan.

It is another object of the present invention to allow owners of existing refrigeration units to comply with current regulations by means of traditional cooling methods.

It is a further object of the present invention to provide food pans that can be stacked together without jamming.

SUMMARY OF THE INVENTION

The present invention is a food pan. In order to cause the air flow across the top of the table to be nearer the surface of the contents of the pan, the pan is provided with louvered vents around an upper periphery of the body of the pan. The vents enable tempered air to flow easily across the surface of the contents of the pan so that the contents are maintained at the proper temperature. The louvers extend outward from the body of the pan so that an anti-jamming mechanism is formed when the pans are stacked together. This construction addresses the two chief problems connected to food pans.

An advantage of the present invention is that for a given temperature at the walls of the serving table, the contents of the pan are maintained at a lower temperature than is possible with prior art pans. The increased efficiency of lowering the temperature of the contents of the pan is due to the airflow being directed downward to the surface of the contents.

Another advantage of the present invention is that a plurality of the pans can be stacked together without becoming jammed, so that the individual pans are easily removed from the stack.

Yet another advantage of the present invention is that the angle of the louver reduces spillage of the contents of the pan.

A still further advantage of the present invention is that due to the presence of the louvered vents, the pans dry more quickly than prior art pans when they are stacked after washing.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
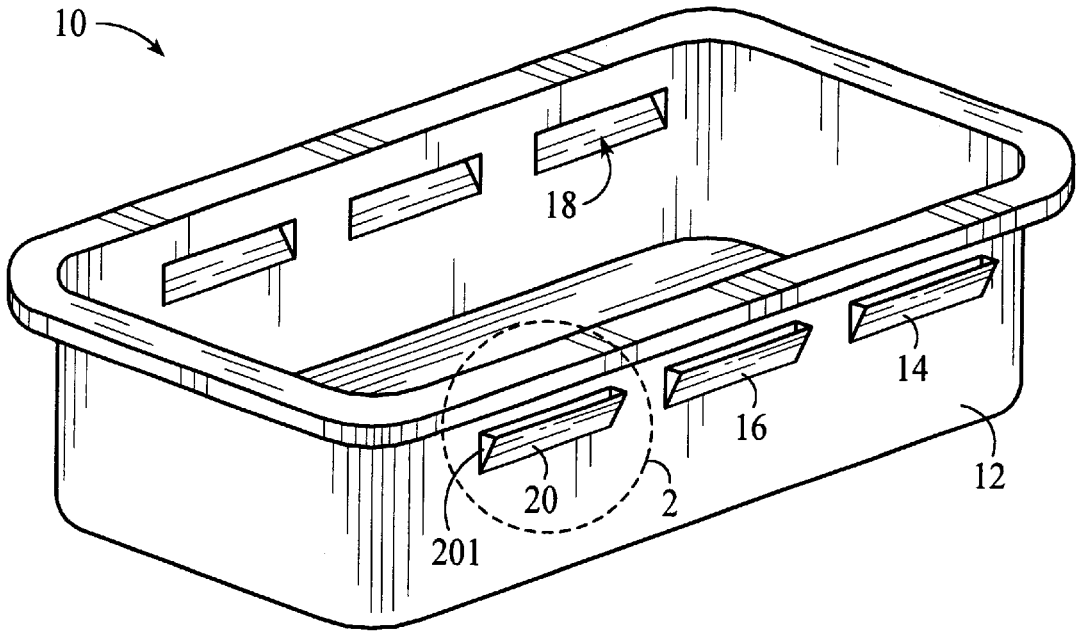
FIG. 1 is a perspective view of the food pan of the present invention.
Figure 2:
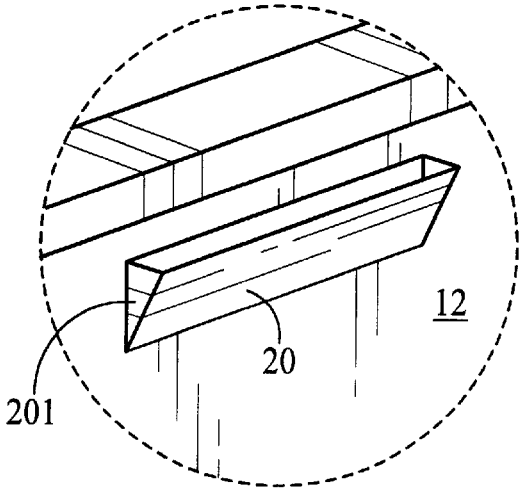
FIG. 2 is a detail view of the area circled in FIG. 1.
Figure 3:
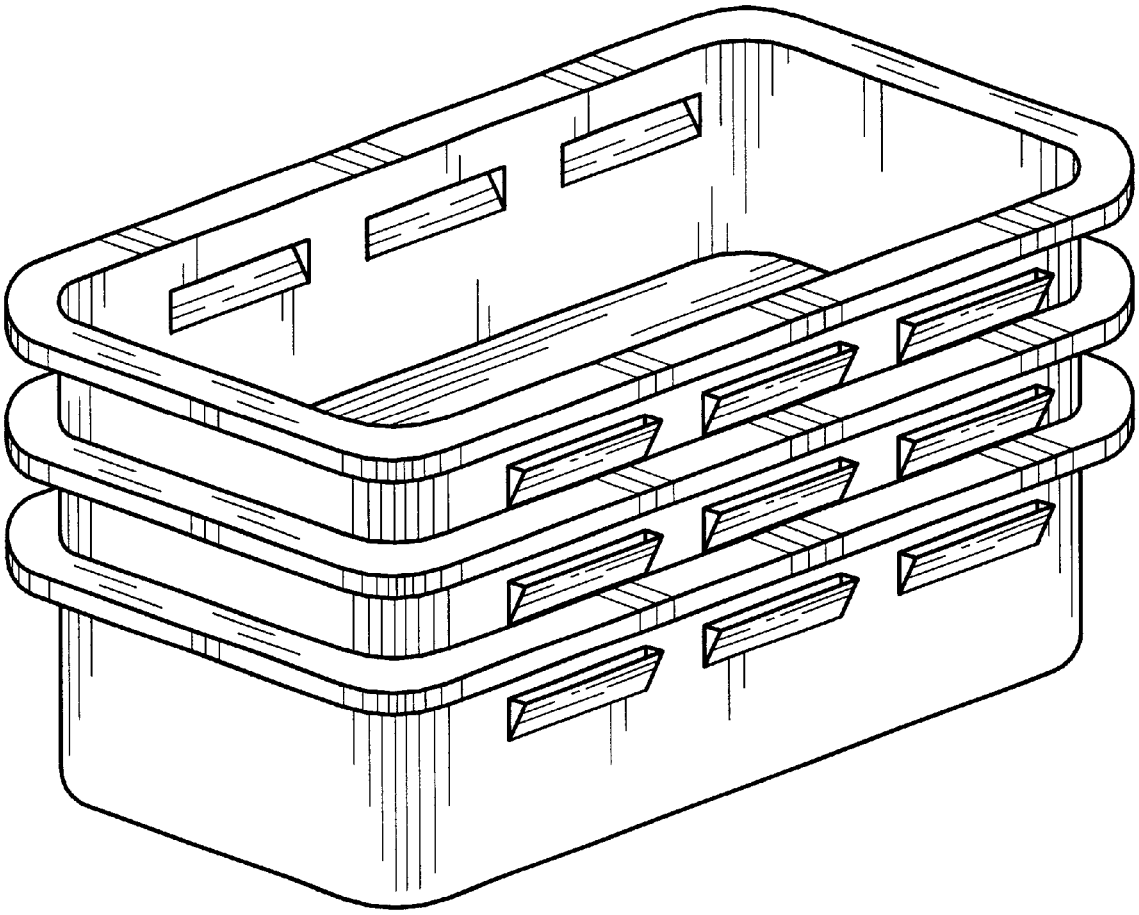
FIG. 3 shows a plurality of the pans stacked together.
Figure 4:
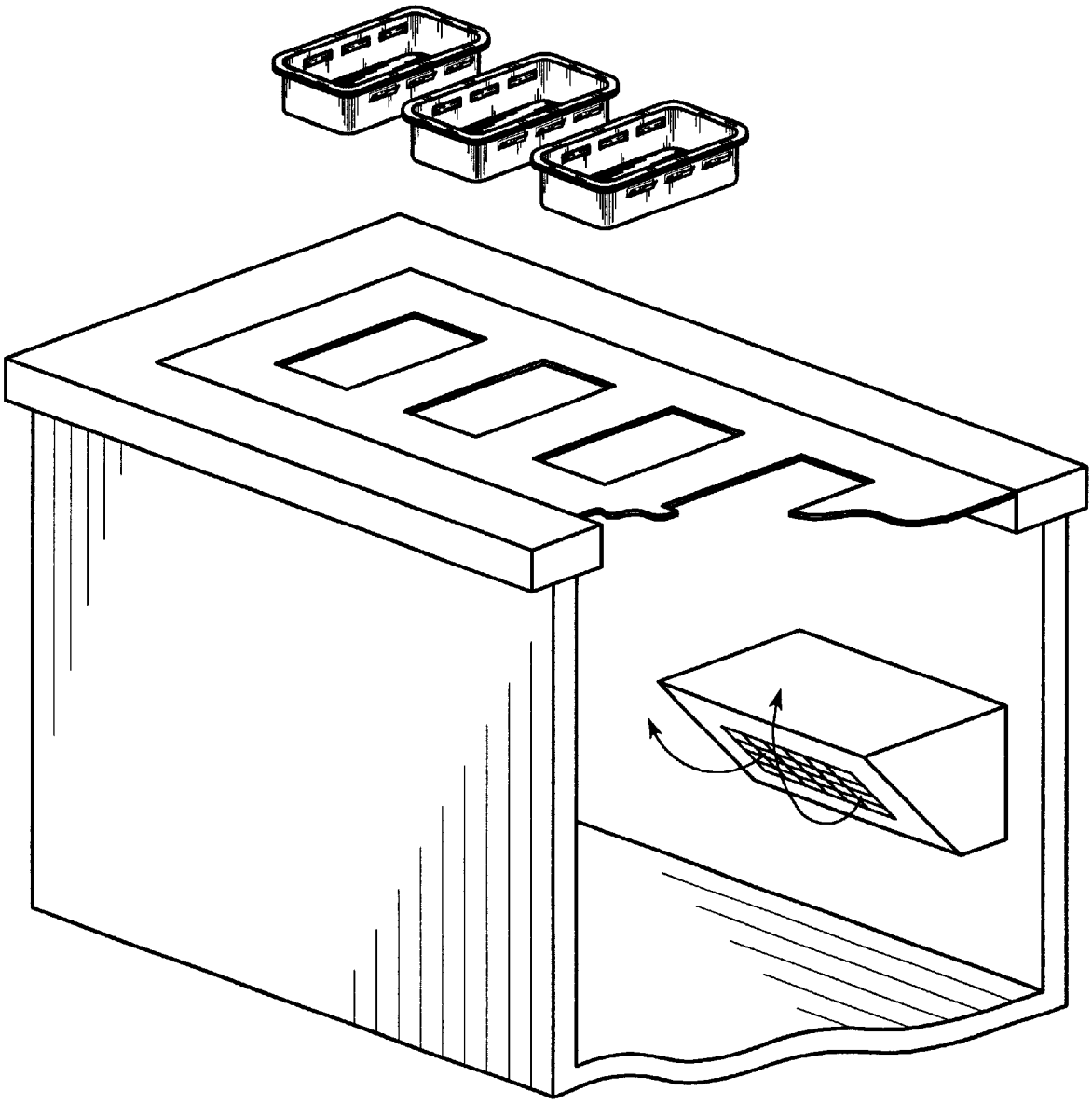
FIG. 4 is a perspective view of a plurality of pans shown with a serving table.

The present invention is a food pan 10. The main body 12 of the pan 10 is constructed similar to that of prior art pans, and can be made in any desired size or shape. An upper end 14 of the pan 10 includes at least one louvered vent 16. The louvered vent 16 comprises an opening 18 in the main body 12 of the pan 10 partially covered by a louver 20. The louver 20 extends outward and upward from the bottom of the opening 18. In order to minimize spillage of the contents and to strengthen the louvered vent 16, a connecting side wall 201 joins the louver 20 with the main body 12 of the pan 10.

The louver 20 thus directs airflow downward and across the surface of the contents of the food pan 10. This maximizes the effect of the tempered air supplied from the serving table.

In addition, the outward angle of the louver 20 allows the louver 20 to act as an anti-jam means when a plurality of the pans are stacked together for storage or for drying. Because the louvered vent 16 increases air flow through the pan 10, the food pan 10 of the present invention dry much more quickly than do the prior art pans.

Further, because of the upward angle of the louver 20, the food pans 10 of the present invention are less prone to spillage that are prior art pans with any ventilation means. While there is of course an open area in the louvered vent 16, the effective area of the opening 18 is significantly reduced by the presence of the louver 20. This of course reduces the amount of food that is spilled when the food is being transported in the food pans 10 of the present invention.

The manufacturer of the food pans 10 can choose to use any number of vents 16, and in nearly any conformation. While it is envisioned that in the preferred embodiments, the pan 10 will include only one row of vents 16, there is certainly no reason a plurality of rows of vents cannot be utilized. Similarly, the vents 16 can extend for the entire length of the wall of the pan, or for any portion of the length of the wall. A given vent row might comprise only one vent 16, or it might comprise any plurality of vents as desired by the user.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A food pan comprising:

at least one side wall forming a main body of said food pan, said side wall includes in an upper area thereof at least one vent, said vent is partially covered by a louver; such that said at least one vent directs an airflow downward and across a surface of contents of said food pan, and said at least one vent serves as an anti-jamming means when a plurality of said food pans are stacked together.

2. The food pan of claim 1 wherein:

said louver extends upward and outward from a bottom side of said vent.

3. The food pan of claim 2 wherein:

a connecting side wall of said louver connects ends of said louver to said main body of said food pan.

4. The food pan of claim 1 wherein:

a plurality of vents are provided in said upper area of said side wall of said food pan.

5. The food pan of claim 1 wherein:

a plurality of vents are provided in said upper area of said side wall of said food pan, and said plurality of vents are arranged in at least two rows such that all of said vents in said plurality of vents are not linearly aligned.

* * * * *